United States Patent [19]

Chevalier

[11] 3,949,536

[45] Apr. 13, 1976

[54] GUIDING DEVICE FOR AN AUTOMATIC BAG-FILLING MACHINE

[75] Inventor: Marcel Chevalier, Uriage (Isere), France

[73] Assignee: Etablissements M. Chapuis, France

[22] Filed: Dec. 26, 1974

[21] Appl. No.: 536,458

[52] U.S. Cl. ..... 53/187; 53/384; 141/114

[51] Int. Cl.[2] ..... B65B 3/16

[58] Field of Search . 141/10, 67, 68, 114, 312–317, 141/265, 281, 282, 372; 53/187–190, 384

[56] References Cited

UNITED STATES PATENTS 2,320,581 6/1943 First et al..... 141/114

*Primary Examiner*—Houston S. Bell, Jr.

*Attorney, Agent, or Firm*—Irving M. Weiner; Pamela S. Burt

[57] ABSTRACT

A guiding device for an automatic bag-filling machine. After the bag has been filled, a finger is disposed in prolongation of front guiding rails. Tube sections are disposed in prolongation of rear guiding rails, with a result that the mouth of the bag is gripped and guided so as to engage between the guiding rails as a conveyor moves the bag along. Creases in the upper portion of the bag are removed on the shifting of the bag along the conveyor.

10 Claims, 10 Drawing Figures

GUIDING DEVICE FOR AN AUTOMATIC BAG-FILLING MACHINE

The present invention relates to a guiding device for facilitating the automatic filling of containers. In particular, the invention relates to a device intended for forming bags on an automatic bag-filling machine.

Such a machine includes a filling device under which the bags to be filled are disposed one after another, while each bag, after being filled, falls on a conveyor belt, and is carried away. During this removal, the open end of the bag is gripped between two longitudinal guiding rails, between which said bag end slides.

The present invention relates more particularly to the correct forming of the open end of a bag between the guiding rails immediately after the filling operation.

BACKGROUND OF THE INVENTION

At the present time, such forming is performed by means of a rod which is pivoted on the machine so as to be able to come and lie in prolongation of the front guiding rail, while a fixed rear plate is located in prolongation of the rear guiding rails. In this way, when the conveyor belt or the conveyor moves forward, the open end of the bag is inserted between the two guiding rails, while being formed by the pivoted rod, on the one hand, and by the rear plate, on the other hand. This known device is disclosed in commonly assigned U.S. Pat. No. 3,896,605 (MBJ-123-A) naming Marcel Chevalier as inventor, the entire disclosure of which is incorporated herein by reference thereto.

This known device has several drawbacks. As a matter of fact, a complicated mechanism must be provided to synchronize the motion of the pivoted rod with the various operating steps. This mechanism must, in particular, after the forward movement of the conveyor, control the falling back of the rod to a vertical position, then the movement of said rod in a forward direction, the raising thereof, and, lastly, the movement of the rod rearwards till said rod lies again in prolongation of the front guiding rail.

The object of the invention is to obviate such drawbacks by providing a forming device which is both simple and inexpensive.

SUMMARY OF THE INVENTION

The present invention provides a guiding device for facilitating the automatic filling of containers, including in combination first means for filling the containers, and a conveyor for receiving the containers when filled. There is also provided second means for guiding the containers moving on the conveyor. There is also provided third means for gripping at least a portion of a filled container and for guiding the filled container to engage with the second means as the conveyor moves the filled container.

A forming device according to the invention, in particular for an automatic bag-filling machine, includes: a filling spout provided with two complementary shell-like parts, and on which the mouth of the bag to be filled is slipped; two pivoted arms, or spacers, on either side of the spout; a conveyor intended to receive the bag after the latter is filled; and, lastly, longitudinal guiding rails intended to guide the open end of the bag during the travel of the latter, and is characterized in that the machine to which it is fitted includes at least two longitudinal guiding rails, to wit, a front rail and a rear rail, which are adapted to be prolonged under the spout by a front guiding assembly including at least one finger, and by a rear guide, respectively, said guide and said guiding assembly being disposed opposite each other and adapted to be brought nearer each other at the same time as the two half-shells of the spout, so as to flatten the upper end of the bag which has just been filled and is released to fall on the conveyor, while then said guide and said guiding assembly are moved away from each other again at the same time as the two half-shells of the spout, after a new bag to be filled has been slipped on the spout.

According to a modified embodiment, the front guiding assembly consists of a single finger, which is disposed downstream of the filling spout with respect to the direction of travel of the conveyor.

According to another modified embodiment, the front guiding assembly comprises two fingers which are disposed in prolongation of each other, one of which lies downstream of the filling spout, while the other lies upstream of said spout, with respect to the direction of travel of the conveyor.

According to another feature of the invention, the two fingers are fixed with respect to each other.

According to a modified embodiment, the fingers are adapted to be parted from each other in a longitudinal direction by a distance approximately equal to, or greater than, the width of an empty bag.

According to another feature of the invention, the machine includes four parallel guiding rails, to wit, a pair of front rails and a pair of rear rails, while the guide is constituted by two tube sections adapted each to prolong one of the two rear rails, and a front finger is constituted by a tube bent in the shape of a U, so that the two front guiding rails are adapted to be prolonged each by one of the two limbs of the U defined by a finger located downstream of the filling spout with respect to the direction of travel of the conveyor.

According to another feature of the invention, the spacers are constituted by arms, which are pivoted on the machine along a horizontal axis transverse to the conveyor, said arms having lengths such that their ends, which are slightly bent towards each other, lie just above the guide and the guiding assembly when the spacers are parted.

According to another feature of the invention, means are provided to make the opening and closing motion of the spout control the opening and closing of the guiding device.

BRIEF DESCRIPTION OF THE DRAWINGS

The accompanying drawing, which is given by way of nonlimiting drawing, will allow understanding the features of the invention more clearly.

DETAILED DESCRIPTION OF SOME PREFERRED EMBODIMENTS OF THE INVENTION

Figure 1:
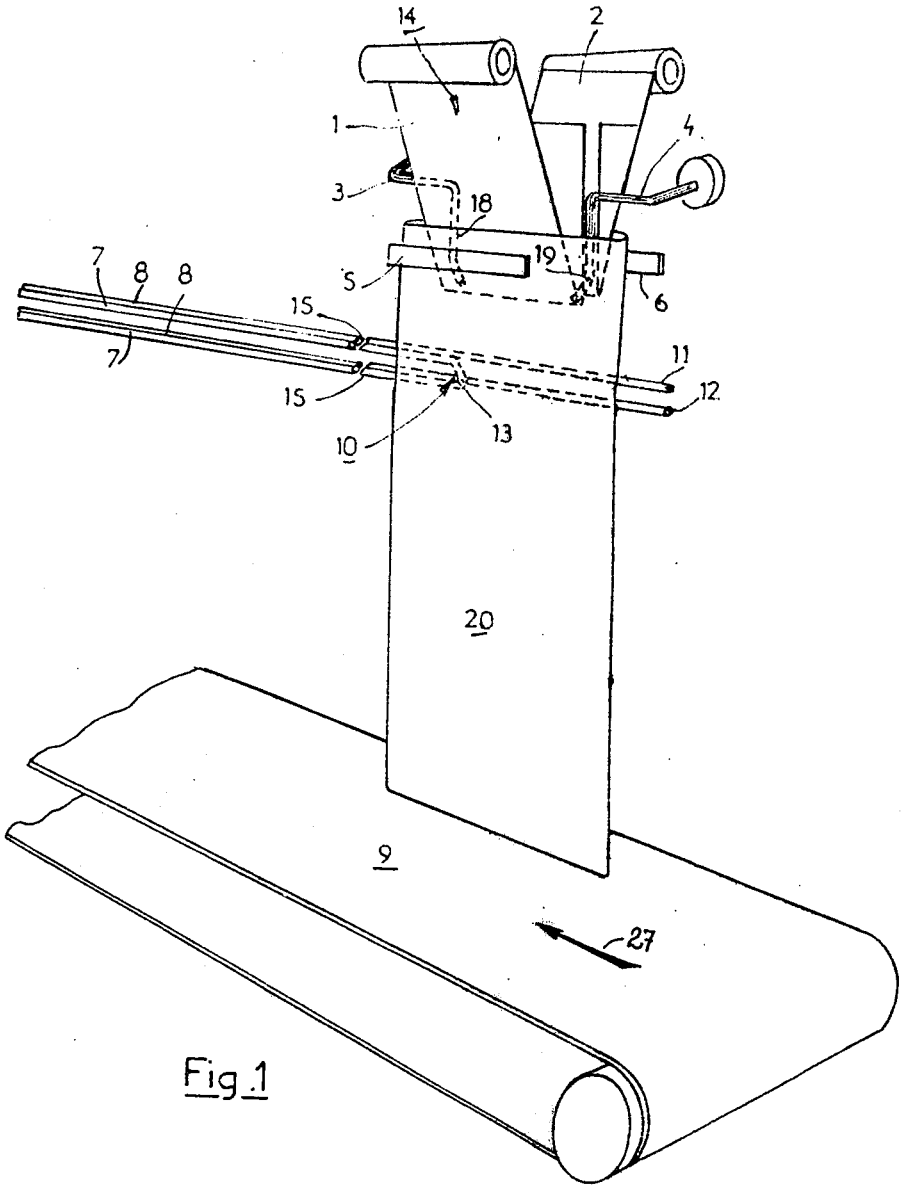
FIG. 1 is a perspective diagrammatic view of a machine provided with a guiding device according to the invention.

FIG. 1 shows an automatic container-filling or bag-filling machine. The machine has first means for filling the containers, said first means including:

- a filling spout 14 constituted by two complementary shells 1 and 2;
- two spacers 3 and 4; and two fixed jaws 5 and 6.

The machine also includes:

- a conveyor belt 9;
- a guiding device 10; and
- second means comprising four longitudinal guiding rails, to wit, two front rails 7 and two rear rails 8.

The invention relates more particularly to the guiding device 10, also referred to herein as third means for gripping at least a portion of a filled container or bag and for guiding the filled bag to engage with said second means as said conveyor moves the filled bag.

Said device 10 comprises:

- a rear guide consisting of two parallel tube sections, to wit, an upper tube section 11 and a lower tube section 12;
- a front guiding assembly consisting of a finger 13, which may be a tube bent in the shape of a U.

The guiding device 10 is disposed under the filling spout 14. The tube sections 11 and 12 of the rear guide are adapted to come to lie each in prolongation of one of the two rear guiding rails 8, respectively.

The finger 13 lies in close proximity to the guiding rails 7 and 8, and upstream of the spout 14 with respect to the direction of travel 27 of the conveyor belt 9. The limbs 15 of the U defined by said finger 13 are adapted to come and lie in prolongation of the front guiding rails 7.

The spacers 3 and 4 end in arms 18 and 19, which are substantially vertical and pivoted on horizontal axes parallel to the conveyor belt 9. Said arms 18 and 19 have lengths such that their ends, which are rounded, lie in close proximity to the guiding device 10.

The operation is as follows:

At the start, the half-shells 1 and 2 of the spout 14 are closed; the spacers 3 and 4 are near each other; the tube sections 11 and 12 lie in prolongation of the rear guiding rails 8; the finger 13 lies in prolongation of the front guiding rails 7; lastly, a container or bag 20 is disposed on the machine, with its mouth slipped on the spout 14, as shown in FIG. 1.

Figure 2:
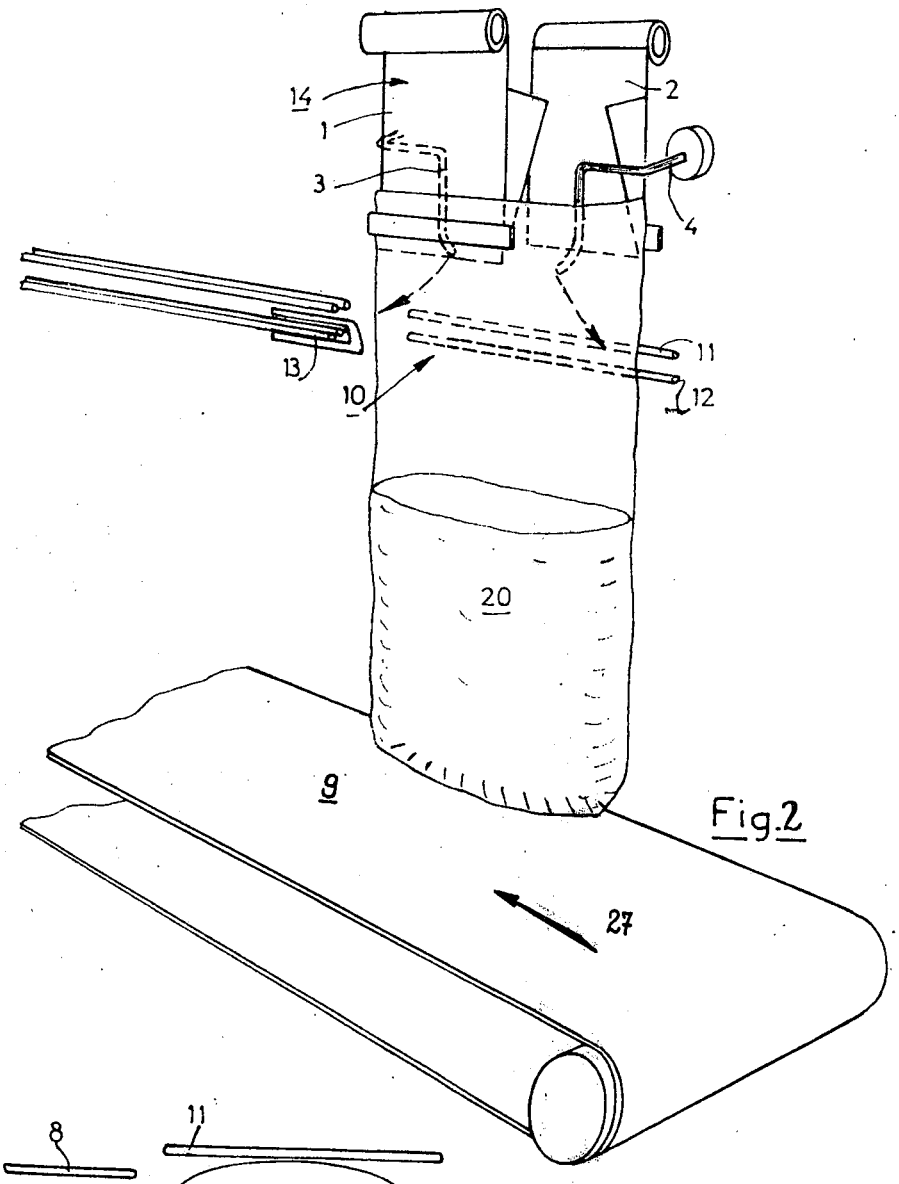
FIG. 2 is a view of a bag being filled.
Figure 3:
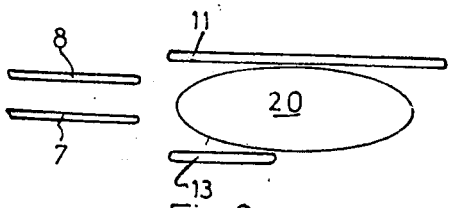
FIG. 3 is a view showing the position of a bag with respect to the guiding device during a filling operation.

The opening of the spout 14 and that of the guiding device 10, that is, the motion of the tube sections 11 and 12 away from the finger 13, take place first. A mechanism (not shown) makes it possible to make the parting of the two half-shells 1 and 2 of the spout 14 control the motion of the rear guide (constituted by the tube sections 11 and 12) away from the finger 13. When once these operations are completed, the disposition of the various elements with respect to each other is shown in FIGS. 2 and 3.

The bag 20 is then filled, after which there are three simultaneous operations:

- closing the spout 14,
- parting the spacers 3 and 4,
- and bringing the tube sections 11 and 12 and the finger 13 closer to each other again.

Figure 4:
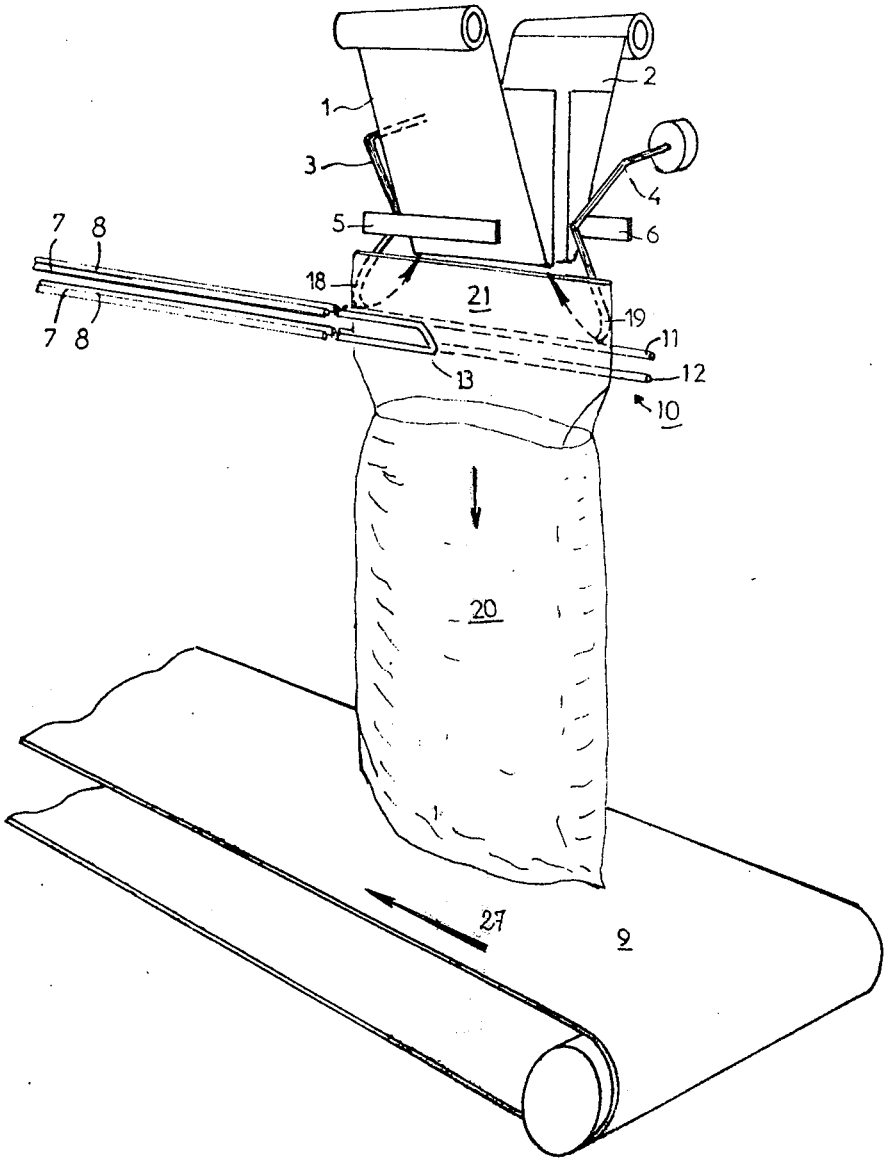
FIG. 4 is a view showing a filled-up bag resting on the conveyor.

In this way, the bag 20 is released, and falls on the conveyor belt 9, while its mouth 21 is held duly stretched by the spacers 3 and 4, and is gripped between the tube sections 11 and 12 and the finger 13. This condition is shown in FIG. 4.

Figure 6:
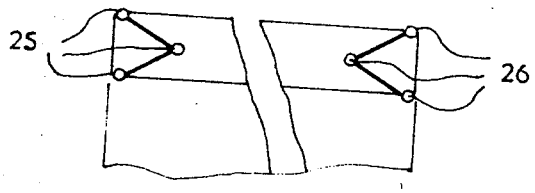
FIG. 6 is a view of a so-called "gusset bag".

Of course, in the case of a "gusset" bag as shown in FIG. 6, and in order not to remove the inner fold of the bag, the spacers 3 and 4 are constituted each by a set of three tongs 25 and 26, respectively, which allow keeping said fold.

Figure 5:
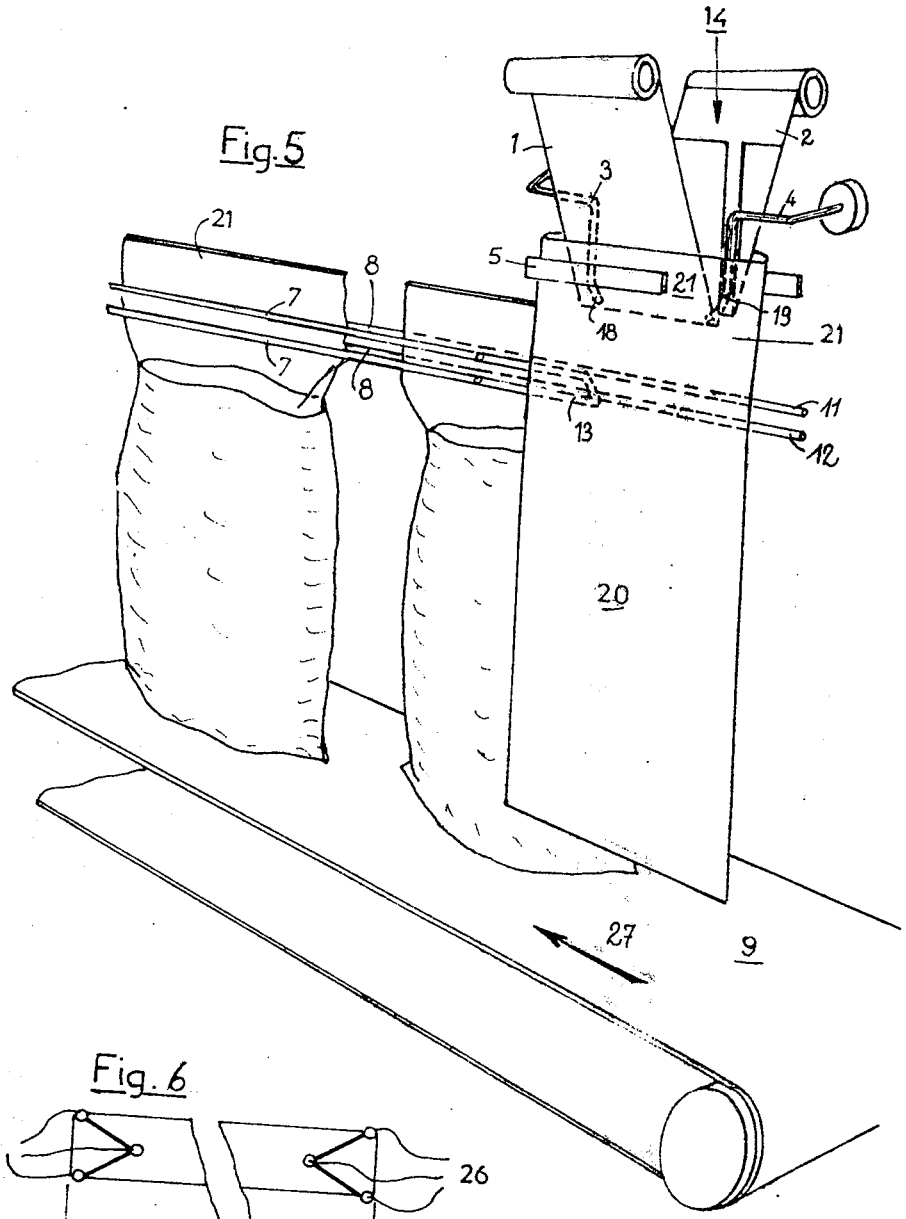
FIG. 5 is a view showing a filled bag being carried away by the conveyor.

The conveyor 9 is then started in the direction 27, and carries along the bag 20, the mouth portion 21 of which fits between the guiding rails 7 and 8 (FIG. 5).

Figure 7:
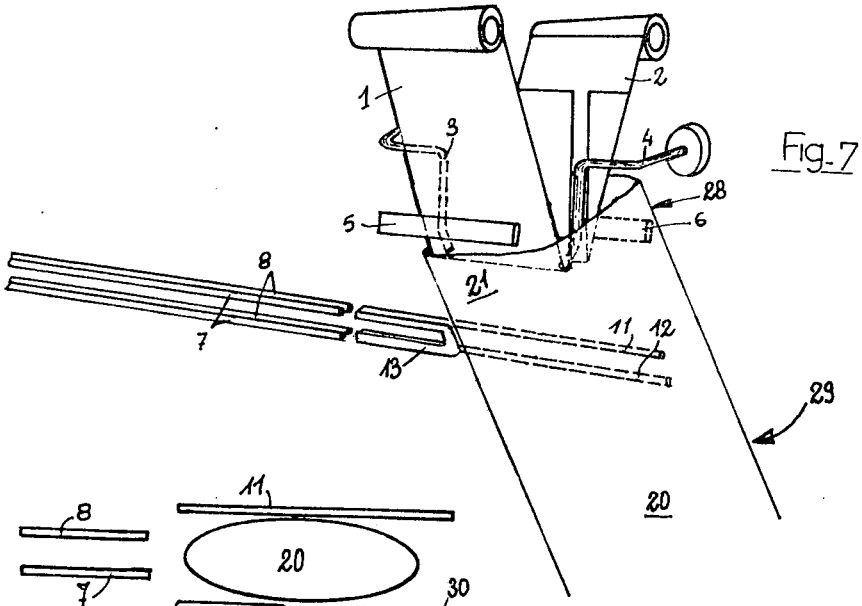
FIG. 7 is a view showing the positioning of a new bag to be filled.

A new empty bag 20 is then disposed on the spout 14 (FIG. 7), as follows: the bag 20 is presented obliquely, by introducing first the right-hand side 28 of its mouth 21 on the right-hand side of the spout 14. The bag 20 is then made to pivot in the direction of the arrow 29, so that its mouth 21 is completely fitted over the spout 14, while the bag 20 slips simultaneously between the tube sections 11 and 12 and the finger 13. The machine is then ready for a new working cycle.

Figure 8:
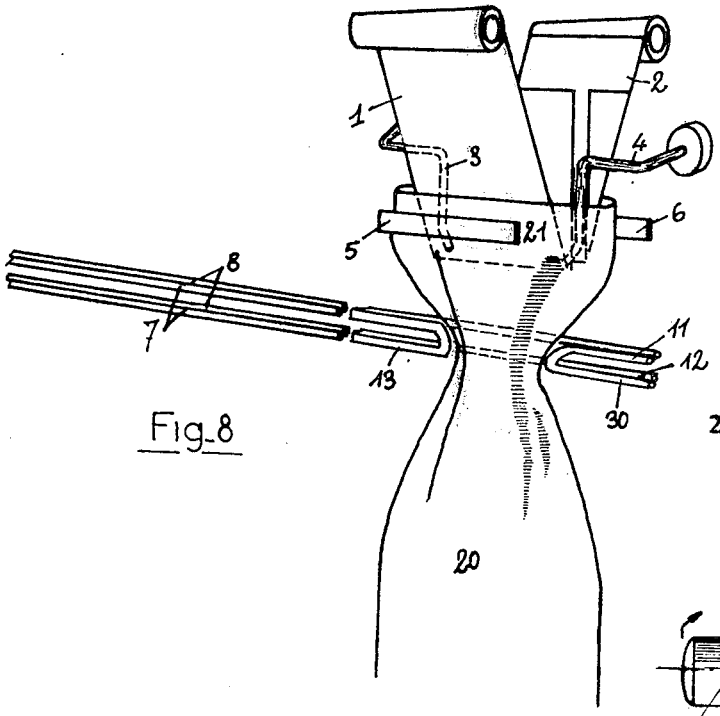
FIG. 8 is a view showing the positioning of a new bag on a machine provided with a guiding device according to a modified embodiment of the invention.

According to a modified embodiment of the invention, the front guiding assembly is constituted not only by the finger 13 but also by another finger 30. This finger 30 is located upstream of the spout 14 with respect to the direction 27 of the motion of the conveyor 9, and has a U-shape identical with that of the finger 13 (FIG. 8). The two fingers 13 and 30 lie in prolongation of each other, but back to back.

In this modified embodiment, a new bag 20 to be filled is positioned while being creased to pass between the two fingers 13 and 30 and bear against the rear guides 8. This embodiment is advantageous in that the bag 20 is held more firmly during its fitting between the guiding rails 7 and 8, but the bags 20 used should be comparatively flexible.

Figure 10:
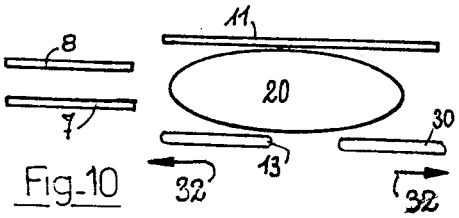
FIGS. 9 and 10 are views showing the positioning of a new bag on a machine provided with a guiding device according to another modified embodiment of the invention.
Figure 9:
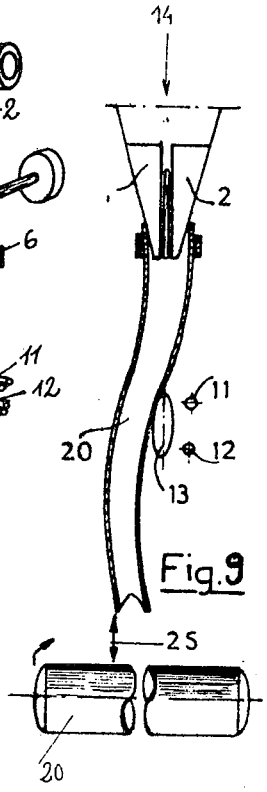

According to a further modified embodiment, the guiding assembly is constituted by two fingers 13 and 30, and said fingers 13 and 30 are adapted to be moved away from each other in a longitudinal direction by a distance approximately equal to or greater than the width of an empty bag 20. The new bag 20 to be filled is, in this case, positioned in the following way:

- the bag 20 is disposed on the machine by slipping the mouth 21 thereof on the spout 14; the bag 20 then bears on the fingers 13 and 30 (FIG. 9);
- after the opening of the spout 14 and the parting of the spacers 3 and 4, the longitudinal parting of the fingers 13 and 30 in the direction 32 is operated, so that the bag 20 comes by itself, through gravity, to a vertical position against the tube sections 11 and 12;
- the fingers 13 and 30 are then brought closer to each other again, in longitudinal direction, and pass before the bag 20 (FIG. 10).

This modified embodiment is likewise advantageous in that the bag 20 is held firmly during the fitting thereof between the guiding rails 7 and 8, but the bags 20 used can be rigid ones.

The advantages of the invention are as follows:

- simultaneous, and hence synchronized, control of the motion of the half-shells 1 and 2 of the spout 14 and the motion of the tube sections 11 and 12 and front guiding assembly;

removal of any creases in the mouth portion 21 of the bag 20 during the fall of the latter, since the ends of the spacers 3 and 4 come very close to the guiding device 10 and therefore keep the mouth 21 of the bag 20 duly stretched during the whole course of the fall;

the mechanism is very simple, and hence inexpensive.

I claim:

1. A guiding device for facilitating the automatic filling of containers, comprising, in combination:

first means for filling said containers;

a conveyor for receiving said containers when filled;

second means for guiding said containers moving on said conveyor; and third means for gripping at least a portion of a filled container and for guiding the filled container to engage with said second means as said conveyor moves the filled container.

2. A guiding device in particular for an automatic bagfilling machine according to claim 1, wherein:

said containers comprise bags;

said first means for filling said containers includes a filling spout having two complementary half-shells on which the mouth of a bag to be filled is slipped, and two arms pivoted on either side of said spout;

said second means for guiding said containers moving along said conveyor includes longitudinal guiding rails for guiding the open end of the bag during the travel of the bag along said conveyor;

said longitudinal guiding rails including a front rail and a rear rail;

said third means including a front guiding assembly and a rear guide;

said front rail is prolonged under said spout by said front guiding assembly;

said rear rail is prolonged under said spout by said rear guide;

said front guiding assembly including at least one finger; and said front guiding assembly and said rear guide being disposed opposite each other and being adapted to be brought closer to each other at the same time as said complementary half-shells of said spout are brought closer to each other in order to flatten the upper end of the bag which has just been filled and is released to fall on said conveyor, while then said front guiding assembly and said rear guide are parted again at the same time as said half-shells after a new bag to be filled has been disposed on said spout.

3. A guiding device according to claim 2, wherein said front guiding assembly consists of a single finger which is located downstream of said filling spout with respect to the direction of travel of said conveyor.

4. A device according to claim 1, wherein said front guiding assembly includes two fingers disposed in prolongation of each other, one of which is located downstream of said filling spout, while the other is located upstream of said filling spout, with respect to the direction of travel of said conveyor.

5. A device according to claim 4, characterized in that said fingers are fixed with respect to each other.

6. A device according to claim 4, characterized in that said fingers are adapted to be parted from each other in a longitudinal direction by a distance which is no less than the width of an empty bag.

7. A device according to claim 2, wherein:

said longitudinal guiding rails include a pair of front rails and a pair of rear rails;

said rear guide includes two tube sections which are each adapted to prolong one of said rear rails;

said front guiding assembly including a tube bent into a U-shape so that said pair of front rails are adapted to be prolonged by the limbs of said U-shaped finger located downstream of said filling spout with respect to the direction of travel of said conveyor.

8. A device according to claim 2, wherein:

said two arms comprise spacers which are pivoted along a horizontal axis transverse to the direction of travel of said conveyor; and said arms each having a length such that their ends, which are slightly bent towards each other, lie just above said front guiding assembly and said rear guide when said spacers are parted from each other.

9. A device according to claim 2, including means for controlling the opening and closing of said front guiding assembly and said rear guides, and for synchronizing said opening and closing with the opening and closing motion of said complementary half-shells of said filling spout.

10. A device according to claim 1, wherein said third means includes at least two fingers which are adapted to be parted from each other in a longitudinal direction by a distance which is equal to no less than the width of an empty container.

* * * * *